US010413005B2

(12) United States Patent
Arnold et al.

(10) Patent No.: US 10,413,005 B2
(45) Date of Patent: Sep. 17, 2019

(54) SLEEVE CONSTRUCTION FOR AN ARTICLE OF APPAREL

(71) Applicant: NIKE, Inc., Beaverton, OR (US)

(72) Inventors: Jacob Arnold, Portland, OR (US); Lindsey V. J. Martin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 212 days.

(21) Appl. No.: 15/479,059

(22) Filed: Apr. 4, 2017

(65) Prior Publication Data

US 2017/0290382 A1 Oct. 12, 2017

Related U.S. Application Data

(60) Provisional application No. 62/319,379, filed on Apr. 7, 2016.

(51) Int. Cl.

| | |
|---|---|
| ***A41D 27/10*** | (2006.01) |
| ***A41D 1/04*** | (2006.01) |
| ***A41D 1/08*** | (2018.01) |
| ***A41D 3/00*** | (2006.01) |
| ***A41D 13/00*** | (2006.01) |
| ***A41D 31/102*** | (2019.01) |
| *A41D 27/02* | (2006.01) |

(52) U.S. Cl.

CPC ..... *A41D 27/10* (2013.01); *A41D 1/04* (2013.01); *A41D 1/08* (2013.01); *A41D 3/00* (2013.01); *A41D 13/0015* (2013.01); *A41D 31/102* (2019.02); *A41D 27/02* (2013.01); *A41D 2200/20* (2013.01); *A41D 2400/10* (2013.01); *A41D 2500/10* (2013.01); *A41D 2500/20* (2013.01)

(58) Field of Classification Search

CPC ..... A41D 1/02; A41D 27/10

See application file for complete search history.

(56) References Cited

U.S. PATENT DOCUMENTS

| | | | | |
|---|---|---|---|---|
| 3,214,771 A | | 11/1965 | Treiber et al. | |
| 4,359,784 A | * | 11/1982 | Harrington | A41D 27/10 2/158 |
| 5,090,058 A | | 2/1992 | Gerber | |
| 8,601,612 B2 | * | 12/2013 | Funk-Danielson | A45C 13/10 2/123 |

(Continued)

OTHER PUBLICATIONS

International Preliminary Report on Patentability dated Oct. 18, 2018 in International Patent Application No. PCT/US2017/026603, 10 pages.

(Continued)

*Primary Examiner* — Tajash D Patel

(74) *Attorney, Agent, or Firm* — Shook Hardy & Bacon, LLP

(57) ABSTRACT

An article of apparel is provided having sleeves with a first panel, a second panel and a third panel. The first panel is generally located on a medial portion of the sleeve, and the second panel and the third panel are generally located on a lateral portion of the sleeve. The sleeves may also comprise an elastically resilient panel positioned adjacent at least the second panel, such that the elastically resilient panel provides increased range of motion for a wearer.

27 Claims, 8 Drawing Sheets

(56) References Cited

U.S. PATENT DOCUMENTS

| | | | | |
|---|---|---|---|---|
| 2005/0166298 | A1* | 8/2005 | Pieroranzio ..... | A41D 1/06 2/69 |
| 2015/0374050 | A1 | 12/2015 | Farron et al. | |

OTHER PUBLICATIONS

International Search Report and Written Opinion dated Jun. 27, 2017 in International Patent Application No. PCT/US2017/026603, 16 pages.
Communication pursuant to Article 94(3) dated Jul. 26, 2019 in European Patent Application No. 17720315.5, 9 pages.

* cited by examiner

SLEEVE CONSTRUCTION FOR AN ARTICLE OF APPAREL

CROSS-REFERENCE TO RELATED APPLICATIONS

This application claims the benefit of U.S. Provisional Application No. 62/319,379, entitled "Sleeve Construction For An Article of Apparel," and filed Apr. 7, 2016. The entirety of the aforementioned application is incorporated by reference herein.

TECHNICAL FIELD

Aspects herein are generally directed to a sleeve construction for an article of apparel.

BACKGROUND OF THE INVENTION

During the colder months of the year, athletes may choose to wear an article of apparel to protect themselves from the elements and provide additional warmth while participating in physical activity outdoors. These articles of apparel may be embodied as items known in apparel art, such as a jacket or a hooded sweatshirt.

BRIEF DESCRIPTION OF THE DRAWINGS

The present invention is described in detail below with reference to the attached drawing figures, wherein.

DETAILED DESCRIPTION

Figure 1:
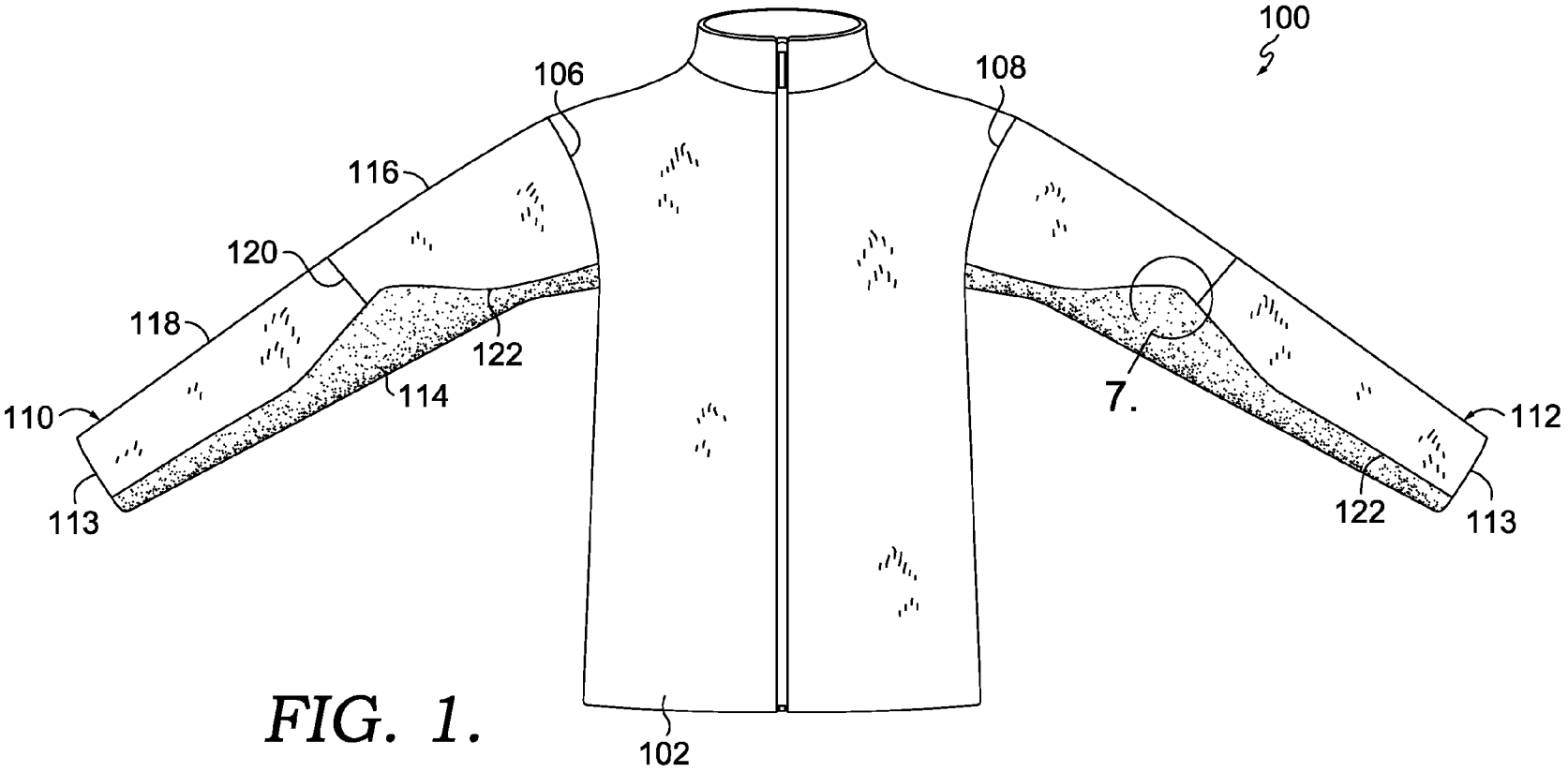
FIG. 1 depicts a front view of an article of apparel having an exemplary sleeve construction, in accordance with aspects herein.

The subject matter of the present invention is described with specificity herein to meet statutory requirements. However, the description itself is not intended to limit the scope of this disclosure. Rather, the inventors have contemplated that the disclosed or claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein are generally directed to an exemplary sleeve construction for an article of apparel for an upper torso of a wearer, such a jacket, top, or hooded sweatshirt. Additionally, the teachings of this disclosure may be applied to articles of apparel for a lower body of a wearer as well, such as pants. In embodiments in which the construction described herein is applied to a lower body garment, it is contemplated that the construction described herein may be applied to either an anterior portion or a posterior portion of the lower body garment, in order to increase the range of motion of a wearer.

The sleeve construction is configured to provide protection from the elements as well as to facilitate an increased range of motion and comfort for a wearer. An athlete wearing an article of apparel having full length sleeves may notice a decrease in arm mobility when compared to wearing an article of apparel having short sleeves. In order to combat this decrease in arm mobility, this disclosure provides a sleeve construction utilizing an outer sleeve assembly and an inner sleeve assembly. The outer sleeve assembly is formed generally of a material, such as a composite material, that is resistant to water but yet is breathable. In some exemplary aspects, the outer sleeve assembly may comprise at least a medial or first panel generally located on a medial portion of the sleeve construction. The medial panel may be formed of a knit material to decrease friction and/or noise incident to the wearer's arm rubbing against the body of the article of apparel such as may occur with arm movements during running, and the like.

The outer sleeve assembly may further comprise second and third panels that are generally located on a lateral portion of the sleeve construction. In exemplary aspects the second panel may comprise a proximal end coupled at least to a sleeve opening of the article of apparel and a distal end or edge located approximately midway between the proximal and distal ends of the sleeve. The third panel may comprise a proximal end or edge that is discontinuously affixed to the distal end or edge of the second panel to form an opening. The distal end of the third panel may, in some exemplary aspects, extend to the distal portion of the sleeve and in some exemplary aspects, may help to form the distal sleeve end. When in an as-worn configuration, the opening created between the distal end or edge of the second panel and the proximal end or edge of the third panel is positioned adjacent to a wearer's elbow region. Continuing, in exemplary aspects, the second and third panels may be formed of a woven material that is generally resistant to abrasion and/or snagging.

The sleeve construction may further comprise an inner sleeve assembly in the form of an elastically resilient panel for facilitating greater range of motion, breathability, air permeability, and comfort for the wearer of the sleeve construction. As used throughout this disclosure, the term "elastically resilient" may be defined as the ability of a material to return to a neutral state after being subject to a tensioning force. In aspects herein, this may be accomplished by incorporating elastic yarns, fibers, or filaments in the elastically resilient panel such as Spandex, Lycra, elastane, rubber, and the like), and/or by engineering the structure of the elastically resilient panel. To put it another way, the term elasticity may be used herein to describe the modulus of elasticity of the elastically resilient panel. In exemplary aspects, the elastically resilient panel may have a greater amount of elasticity than first, second, and third panels described above. To put it another way, the elastically resilient panel may have a lower modulus of elasticity than the first, second, and third panels.

In exemplary aspects, the elastically resilient panel is positioned adjacent to the second panel such that an outer-facing surface of the elastically resilient panel is adjacent to an inner-facing surface of the second panel. The elastically resilient panel may comprise at least a proximal end that may, for instance, be affixed to the sleeve opening of the article of apparel and a distal end or edge that is affixed to the proximal end or edge of the third panel such that the elastically resilient panel spans the opening created between the edges of the second and third panels as described above. This positioning may cause the elastically resilient panel to act as a cantilever between the second panel and the third panel. In other words, when the elastically resilient panel is carrying a tension force due to, for example, the wearer of the article of apparel bending his arm at the elbow, the tension force provided by the elastic characteristics of the elastically resilient panel acts to assist the sleeve construction in returning to a straight or "neutral" configuration when the wearer straightens his arm. Because the elastically resilient panel is positioned such that it spans the opening between the second and third panels, the elastically resilient panel may only be visible between the second panel and the third panel when the sleeve is in a bent configuration. In exemplary aspects, the elastically resilient panel may be formed of a mesh material to further increase the breathability and permeability characteristics of the sleeve construction.

In exemplary aspects, an article of apparel for an upper torso of a wearer is provided. The article of apparel comprises at least one front panel adapted to cover a front torso area of the wearer when the article of apparel is in an as-worn configuration, and at least one back panel adapted to cover a back torso area of the wearer when the article of apparel is in the as-worn configuration. Additionally, the article of apparel further comprises at least a first sleeve opening positioned at least partially between the front panel and the back panel, and at least a first sleeve coupled to the first sleeve opening and terminating at a distal end. The first sleeve further comprises an outer sleeve assembly comprising a first panel extending from the first sleeve opening to the distal end, a second panel extending from the first sleeve opening to a point approximately midway the length of the sleeve where it terminates in a first edge, and a third panel extending from the point approximately midway the length of the sleeve to the distal end. Further, the third panel comprises at least a first edge that is discontinuously affixed to the first edge of the second panel to form an opening, wherein the second panel and the third panel are further affixed to the first panel at least at a first seam and a second seam, and an inner sleeve assembly positioned adjacent to a portion of the outer sleeve assembly, the inner sleeve assembly comprising an elastically resilient panel having at least a first edge affixed to the first sleeve opening and a second edge affixed to the first edge of the third panel.

In another aspect, an article of apparel for an upper torso of a wearer is provided. The article of apparel comprises at least a front panel adapted to cover a front torso area of the wearer when the article of apparel is in an as-worn configuration and at least a back panel adapted to cover a back torso area of the wearer when the article of apparel is in the as-worn configuration. Further, the article of apparel comprises a first sleeve opening positioned at least partially between the front panel and the back panel and at least a first sleeve coupled to the first sleeve opening. The first sleeve comprises a medial panel extending from the first sleeve opening towards a distal end of the first sleeve, a lateral proximal panel extending from the first sleeve opening to a first edge, wherein the first edge is positioned approximately midway between a proximal end of the sleeve and the distal end of the sleeve, and a lateral distal panel, wherein a first edge of the lateral distal panel is discontinuously affixed to a portion of the first edge of the lateral proximal panel thereby forming an opening, and wherein a second edge of the lateral distal panel forms at least a portion of the distal end. Additionally, the article of apparel may comprise an inner panel having an elastically resilient material, the inner panel positioned adjacent to the lateral proximal panel and extending from the first sleeve opening to the first edge of the lateral distal panel.

In yet another aspect, a sleeve for an article of apparel is provided. The sleeve comprises a proximal end and a distal end, a medial panel extending from the proximal end of the sleeve towards the distal end of the sleeve, the medial panel comprising a knit fabric, a lateral proximal panel extending from the proximal end of the sleeve to a first edge, wherein the first edge is positioned approximately midway between the proximal end and the distal end of the sleeve, the lateral proximal panel comprising a woven fabric, a lateral distal panel, wherein a first edge of the lateral distal panel is discontinuously affixed to the first edge of the lateral proximal panel, and wherein a second edge of the lateral distal panel forms at least a portion of the distal end, the lateral distal panel comprising a woven fabric, and an inner panel positioned adjacent to an inner-facing surface of the lateral proximal panel and extending from the proximal end of the sleeve to approximately midway between the proximal end and the distal end of the sleeve, wherein a distal edge of the inner panel is affixed to the first edge of the lateral distal panel.

In yet another aspect, a construction for an article of apparel comprises a proximal end and a distal end, wherein the proximal end is configured to be affixed to the article of apparel, a first panel extending from the proximal end of the construction to a first edge, a second panel having a proximal edge that is discontinuously affixed to the first edge of the first panel to form an opening, and a third panel comprising an elastically resilient material positioned adjacent to an inner-facing surface of the first panel and extending from the proximal end of the construction to a distal edge, wherein the distal edge of the third panel is affixed to the proximal edge of the second panel.

As used throughout this disclosure, terms such as anterior, posterior, lateral, medial, proximal, distal, and the like are meant to be given their common anatomical meaning with respect to the article of apparel being worn by a hypothetical wearer standing in anatomical position. Further, although the term "panel" may be used herein when describing the exemplary sleeve construction, the term is not meant to be limited to a single piece of material that is joined to other panels via technologies such as stitching, bonding, welding, and the like. Instead, the term "panel" may also be used to define different portions of a sleeve construction (e.g., medial, lateral, proximal, distal, and the like) engineered through seamless technology. In other words, the sleeve construction described herein may be formed using a single piece of engineered fabric, where the engineered fabric is knit or woven to have different portions exhibiting different knit or woven structures, different layers, and/or different functional characteristics. Any and all aspects, and any variation thereof, are contemplated as being within the scope herein.

Figure 2:
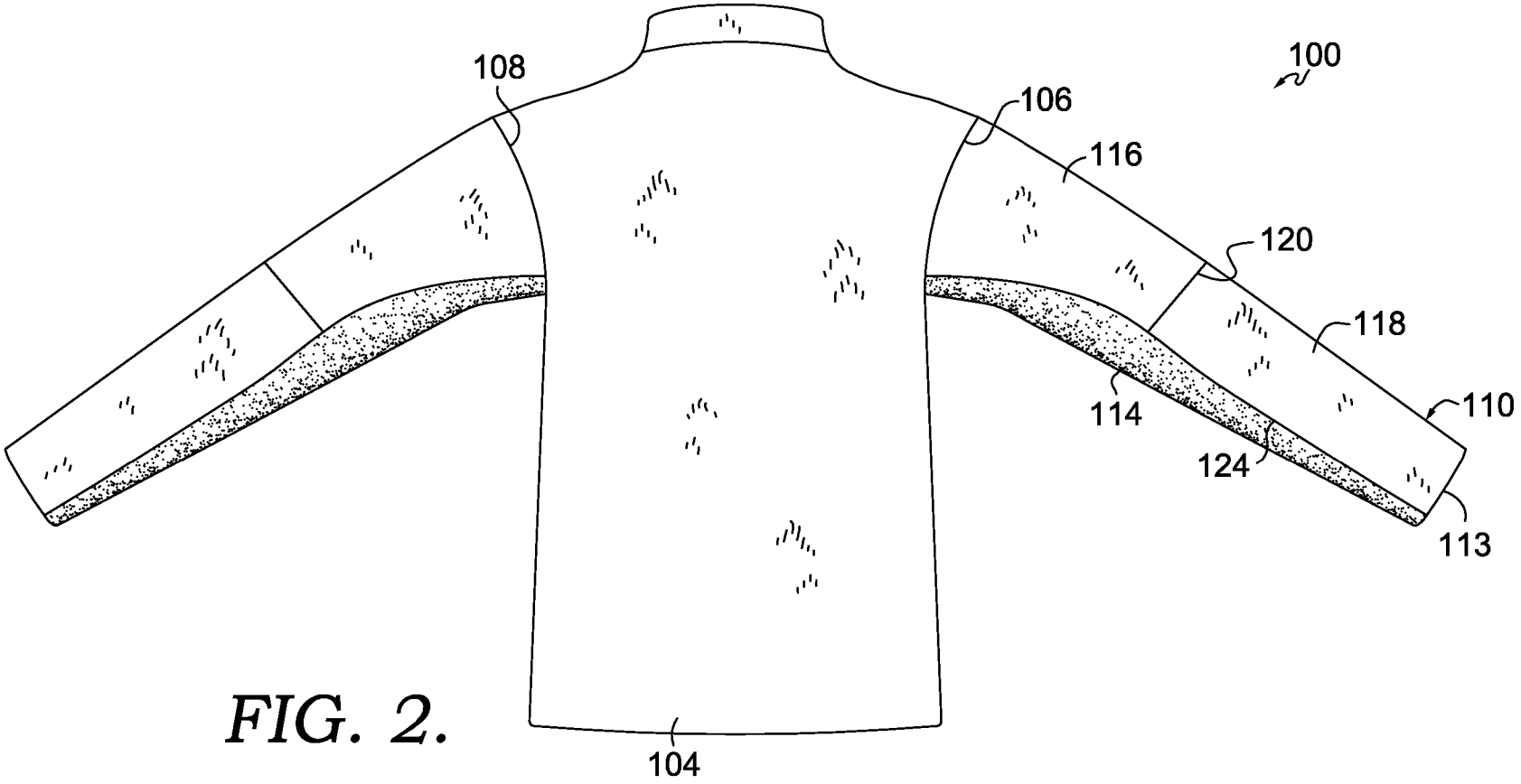
FIG. 2 depicts a back view of the article of apparel of FIG. 1, in accordance with aspects herein.

Turning now to FIGS. 1 and 2, these figures depicts front and back views respectively of an article of apparel 100, in accordance with aspects herein. In general, the article of apparel 100 is configured for an upper torso of a wearer when worn. Further, although the article of apparel 100 is shown as a jacket, it is contemplated herein that the article of apparel 100 may be in other forms, such as a coat, shirt, top, pullover, hooded sweatshirt, and the like. Moreover, the sleeves shown on article of apparel 100 may have lengths other than the full length sleeve as shown. For instance, the sleeves may be any length which allows for the sleeve construction described herein to be present on the article of apparel 100.

In exemplary aspects and as shown in FIG. 1, a front view of the article of apparel 100 comprises at least a front panel 102. As shown in FIG. 2, a back view of the article of apparel 100 comprises at least a back panel 104. The front panel 102 is generally adapted to cover a front torso of a wearer when the article of apparel 100 is in an as-worn configuration, while the back panel 104 is generally adapted to cover a back torso area of a wearer when the article of apparel 100 is in an as-worn configuration. Although FIG. 1 depicts the article of apparel 100 as having two front panels releasably coupled by a zipper-type mechanism, it is contemplated herein that the front panel 102 may comprise a unitary panel or it may comprise one or more additional sub-panels. Similarly, the back panel 104 may comprise a unitary panel as shown or it may comprise one or more additional sub-panels. As well, the front and back panels 102 and 104 may, in some aspects, comprise a unitary panel having a front side and a back side. Any and all aspects and any variation thereof are contemplated as being within the scope herein.

In exemplary aspects, the article of apparel 100 further comprises a first sleeve opening 106 and a second sleeve opening 108, where the first sleeve opening 106 and the second sleeve opening 108 are defined at least partially by the front panel 102 and the back panel 104. For example, in one aspect, the first sleeve opening 106 and the second sleeve opening 108 may be formed from the front panel 102 and the back panel 104 being adjoined to one another. However, in another aspect, the first sleeve opening 106 and the second sleeve opening 108 may be defined or formed from one or more additional panels positioned between the front panel 102 and the back panel 104 (e.g., side panels, shoulder panels, and the like). In this aspect, it is understood that the article of apparel 100 having the first sleeve opening 106 and the second sleeve opening 108 may comprise any number of additional panels between the front panel 102 and the back panel 104, such that the first sleeve opening 106 and the second sleeve opening 108 continue to be positioned at least partially between the front panel 102 and the back panel 104.

Further, the article of apparel 100 comprises a first sleeve 110 and a second sleeve 112 coupled to the first sleeve opening 106 and the second sleeve opening 108, respectively. For the purposes of discussion herein, it is understood that the first sleeve opening 106, the first sleeve 110, the second sleeve opening 108, and the second sleeve 112 may be present on the right and left sides respectively of the article of apparel 100. Additionally, for the discussion of the following features of the article of apparel 100, it is to be understood that although the features are generally described as being on the first sleeve 110 of the article of apparel 100, any or all of the features described herein may be present on the second sleeve 112 of the article of apparel 100 as well.

With continued reference to FIGS. 1 and 2, in exemplary aspects the first sleeve 110 may comprise a unitary or single-piece first panel 114, which may extend from the first sleeve opening 106 to a distal end 113 of the first sleeve 110. The first panel 114 is generally located or positioned on a medial aspect of the first sleeve 110 such that it may be positioned closest to a wearer's body when the article of apparel 100 is in an as-worn configuration. As such, for the purposes of discussion herein, the first panel 114 may also be referred to as a medial panel. Additionally, although the first panel 114 is depicted in FIGS. 1 and 2 as being a unitary or single-piece panel, it is contemplated herein that the first panel 114 may instead be formed of smaller panels. For example, the first panel 114 may comprise two or more smaller sub-panels.

In exemplary aspects, the first panel 114 may generally be formed from a knit fabric. And further, as explained below, the knit fabric may comprise a composite fabric that exhibits resistance to water and breathability characteristics. Having the first panel 114 be comprised of a knit fabric may create a lower coefficient of friction between a wearer's arm and the side of a wearer's torso. In accordance with one aspect herein, it is contemplated that the coarseness or fineness of the knit fabric used to form first panel 114 may be adjusted to achieve the lowest coefficient of friction possible between the first sleeve 110 and the article of apparel 100. Having a low coefficient of friction may reduce the noise associated with the pumping action that occurs incident to the wearer's arm rubbing against the body of the article of apparel 100 during, for instance, typical running exercises. Although the first panel 114 is described as being formed of a knit fabric, it is contemplated herein that the first panel 114 may be formed of a woven fabric, a non-woven fabric, and the like.

Further, in accordance with one aspect seen in FIGS. 1 and 2, the first panel 114 may be configured to generally extend around approximately one-half of the circumference of the first sleeve 110 adjacent the first sleeve opening 106 and adjacent the distal end 113. Additionally, the first panel 114 may extend around approximately three-quarters of the circumference of the first sleeve 110 at a location approximately midway between the first sleeve opening 106 and the distal end 113. This location generally corresponds to an elbow region of a wearer when the article of apparel 100 is worn. This region may experience a higher degree of rubbing against the body of the article of apparel 100 during the arm pumping action often seen in sports such running as compared to other regions or portions of the first sleeve 110. Thus, by having this area comprise a larger surface area of the knit material described above, friction and noise associated with the arm pumping action may be reduced.

Still with continued reference to FIGS. 1 and 2, the first sleeve 110 may further comprise a second panel 116 and a third panel 118 shown as being positioned at a lateral portion of the first sleeve 110. In accordance with one aspect herein, the second panel 116 and the third panel 118 may be referred to as a lateral proximal panel and a lateral distal panel, respectively. In exemplary aspects, both the second panel 116 and the third panel 118 may generally be formed from a woven material. Similarly to the first panel 114, the coarseness or fineness (i.e., weave) of the woven material may be adjusted to provide optimal characteristics. For example, the woven material used to form the second panel 116 and the third panel 118 may comprise a looser weave in areas in which the wearer desires increased air permeability, and may be more tightly woven in areas in which the wearer desires additional warmth and/or increased abrasion resistance. Further, as explained below, the material forming the second and third panels 116 and 118 may comprise a composite fabric that exhibits resistance to water and breathability characteristics. Although described as being formed of a woven fabric, it is contemplated herein that the second and third panels 116 and 118 may be formed of a knit fabric, a non-woven fabric, and the like.

In accordance with aspects depicted with respect to the front view of the article of apparel 100 shown in FIG. 1, the first panel 114 may be coupled to the second panel 116 and the third panel 118 along a first seam 122, which may extend from the first sleeve opening 106 to the distal end 113 of the first sleeve 110. In a similar manner, the back view of the article of apparel 100 shown in FIG. 2 depicts that the first panel 114 may be coupled to the second panel 116 and the third panel 118 along a second seam 124, which may extend from the second sleeve opening 108 to a distal end 113 of the second sleeve 112.

As illustrated in FIGS. 1 and 2, the second panel 116 generally extends from the first sleeve opening 106 towards a point approximately midway along the first sleeve 110 (e.g., approximately midway between the first sleeve opening 106 and the distal end 113), where it terminates in a first edge 120. In accordance with aspects herein, the term "midway" generally refers to an area one-half of the length of the first sleeve 110 between the first sleeve opening 106 and the distal end 113. However, other lengths along the length of the first sleeve 110 have been contemplated. For example, it is contemplated that the term "approximately midway" may represent lengths along the first sleeve 110 anywhere between one-quarter to three-quarters of the overall length of the first sleeve 110. Additionally, the third panel 118 comprises at least a first edge (not shown in FIGS. 1 and 2) located at a proximal end of the third panel 118 (the end of the third panel 118 that is closest to the second panel 116). The relationship between the first edge 120 of the second panel 116 and the first edge of the third panel 118 is illustrated in FIG. 3.

Figure 3:
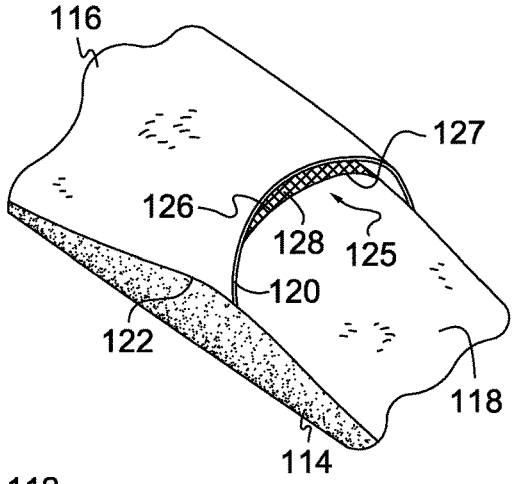
FIG. 3 depicts a perspective view of a portion of the exemplary sleeve construction of FIG. 1, in accordance with aspects herein.

FIG. 3 depicts a perspective view of a portion of the second sleeve 112, in accordance with aspects herein. As seen from the perspective view of FIG. 3, when looking along the length of the second sleeve 112 from the distal end 113 towards the second sleeve opening 108, the first edge 120 of the second panel 116 is discontinuously coupled (either permanently by, for instance, stitching, bonding, adhesives and the like, or releasably by, for example, snaps, buttons, zippers, hook-and-loop fasteners, and the like) to a first edge 126 of the third panel 118. In one aspect, the first edge 120 of the second panel 116 may be discontinuously coupled to the first edge 126 of the third panel 118 at a location proximate the first seam 122 and at a location proximate the second seam 124. Because the first edge 120 of the second panel 116 is discontinuously affixed or coupled to the first edge 126 of the third panel 118, an opening 125 is formed between the second panel 116 and the third panel 118. The length of the opening 125 is dependent on how much of the length of the first edge 120 of the second panel 116 is attached to the first edge 126 of the third panel 118. In one exemplary aspect, the length of the opening 125 may be between 4 and 20 centimeters long, although lengths greater than 20 centimeters and less than 4 centimeters are contemplated herein.

As illustrated in FIG. 3, the second sleeve 112 is in an at-rest or neutral state. In the neutral state, the second sleeve 112 can be thought of as extending linearly away from the second sleeve opening 108 such that second sleeve 112 is straight and not bent. When the second sleeve 112 is in a straight or neutral state, the first edge 120 of the second panel 116 may overlap the first edge 126 of the third panel 118. This aspect can be seen in FIGS. 1 and 2, where only the first edge 120 of the second panel 116 is visible. To put it another way, because of the overlapping relationship between the edges 120 and 126, the first edge 126 of the third panel 118 may be located at a more proximal location along the length of the second sleeve 112 than the first edge 120 of the second panel 116. To put it yet another way, because of the overlapping relationship between the edges 120 and 126, the first edge 120 of the second panel 116 may be located at a more distal location along the length of the second sleeve 112 than the first edge 126 of the third panel 118. As will be explained in greater depth below, FIG. 3 further illustrates an elastically resilient panel 128 that is visible through the opening 125 formed between the first edge 120 of the second panel 116 and the first edge 126 of the third panel 118.

Figure 4:
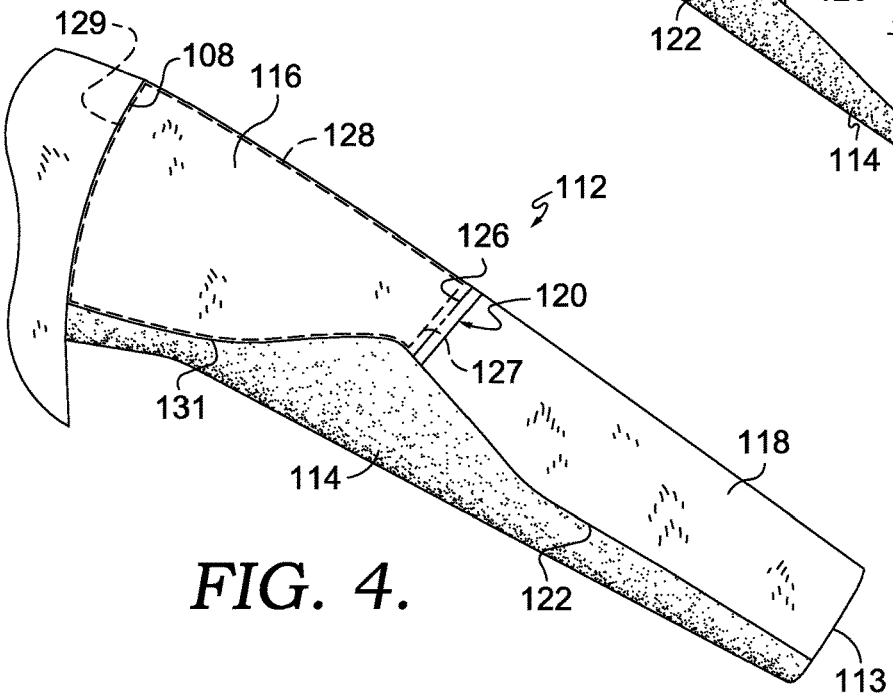
FIG. 4 depicts a front view of an exemplary left sleeve of an article of apparel, in accordance with aspects herein.
Figure 5:
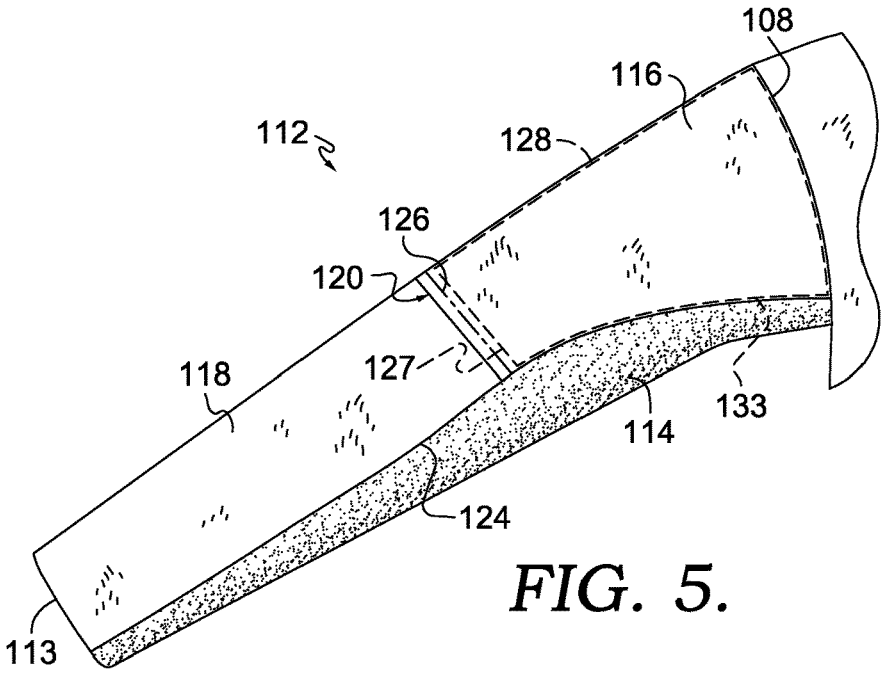
FIG. 5 depicts a back view of the exemplary left sleeve of FIG. 4, in accordance with aspects herein.

Turning now to FIGS. 4 and 5, these figures illustrate front and back views respectively of the second sleeve 112 of the article of apparel 100 in accordance with aspects herein. The second sleeve 112 is shown as being de-coupled from the body of the article of apparel 100. For the purposes of discussion herein, it is to be understood that the aspects described herein with respect to the second sleeve 112 may also be applied to the first sleeve 110.

In addition to the features of the second sleeve 112 discussed with reference to FIGS. 1, 2, and 3, FIGS. 4 and 5 also depict the perimeter shape of the elastically resilient panel 128 as indicated by the dashed line. The elastically resilient panel 128 may comprise a mesh material having elastic characteristics. In exemplary aspects, the elastic characteristics of the elastically resilient panel 128 is greater than the elastic characteristics of the first, second, and third panels 114, 116, and 118. Further, in some exemplary aspects, the elastic characteristics of the first panel 114 may be greater than the elastic characteristics of the second and third panels 116 and 118. In exemplary aspects, the elastically resilient panel 128 is positioned interior to the second panel 116. As shown on FIG. 4, a proximal edge 129 of the elastically resilient panel 128 may be coupled to at least the second sleeve opening 108, a medial edge 131 of the elastically resilient panel 128 may be coupled to at least the first panel 114 at the first seam 122, and a lateral edge 133 of the elastically resilient panel 128 (shown in FIG. 5) may be coupled to at least the first panel 114 at the second seam 124. However it is contemplated herein, that the edges 129, 131, and 133 of the elastically resilient panel 128 may be coupled to the second panel 116 along a perimeter edge of the second panel 116. The elastically resilient panel 128 further comprises a distal edge 127.

The relationship between the different edges of the second and third panels 116 and 118, and the elastically resilient panel 128 are shown in FIGS. 4 and 5. As depicted, the first edge 120 of the second panel 116 extends distally past the first edge 126 of the third panel 118 (indicated by the dotted-dashed line) and further extends distally past the edge 127 of the elastically resilient panel 128. In exemplary aspects, the edge 127 of the elastically resilient panel 128 is affixed to the first edge 126 of the third panel 118 (FIGS. 4 and 5 depict the edges 126 and 127 being slightly offset from one another; this is for illustrative purposes only). This is better seen in the perspective view of FIG. 3, which illustrates the edge 127 of the elastically resilient panel 128 being affixed along its length to the first edge 126 of the third panel 118. Still further, in exemplary aspects, the edge 127 of the elastically resilient panel 128 is not affixed to the first edge 120 of the second panel 116. By configuring the relationship between the edges 120, 126, and 127 as described, the elastically resilient panel 128 spans the opening created by the first edge 120 of the second panel 116 being discontinuously affixed to the first edge 126 of the third panel 118.

Figure 6A:
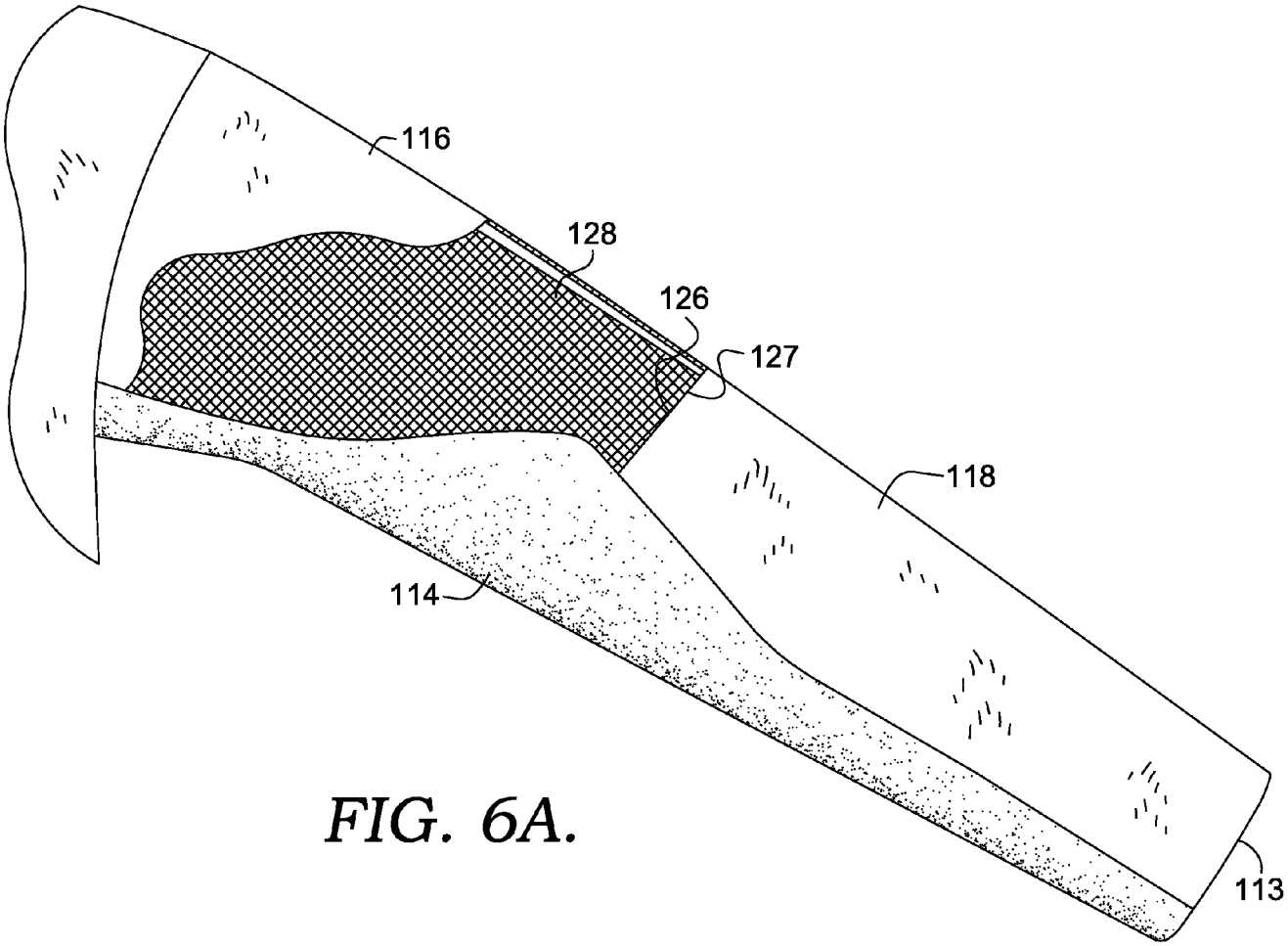
FIG. 6A depicts a cut-away front view of the exemplary left sleeve of FIG. 4, in accordance with aspects herein.
Figure 6B:
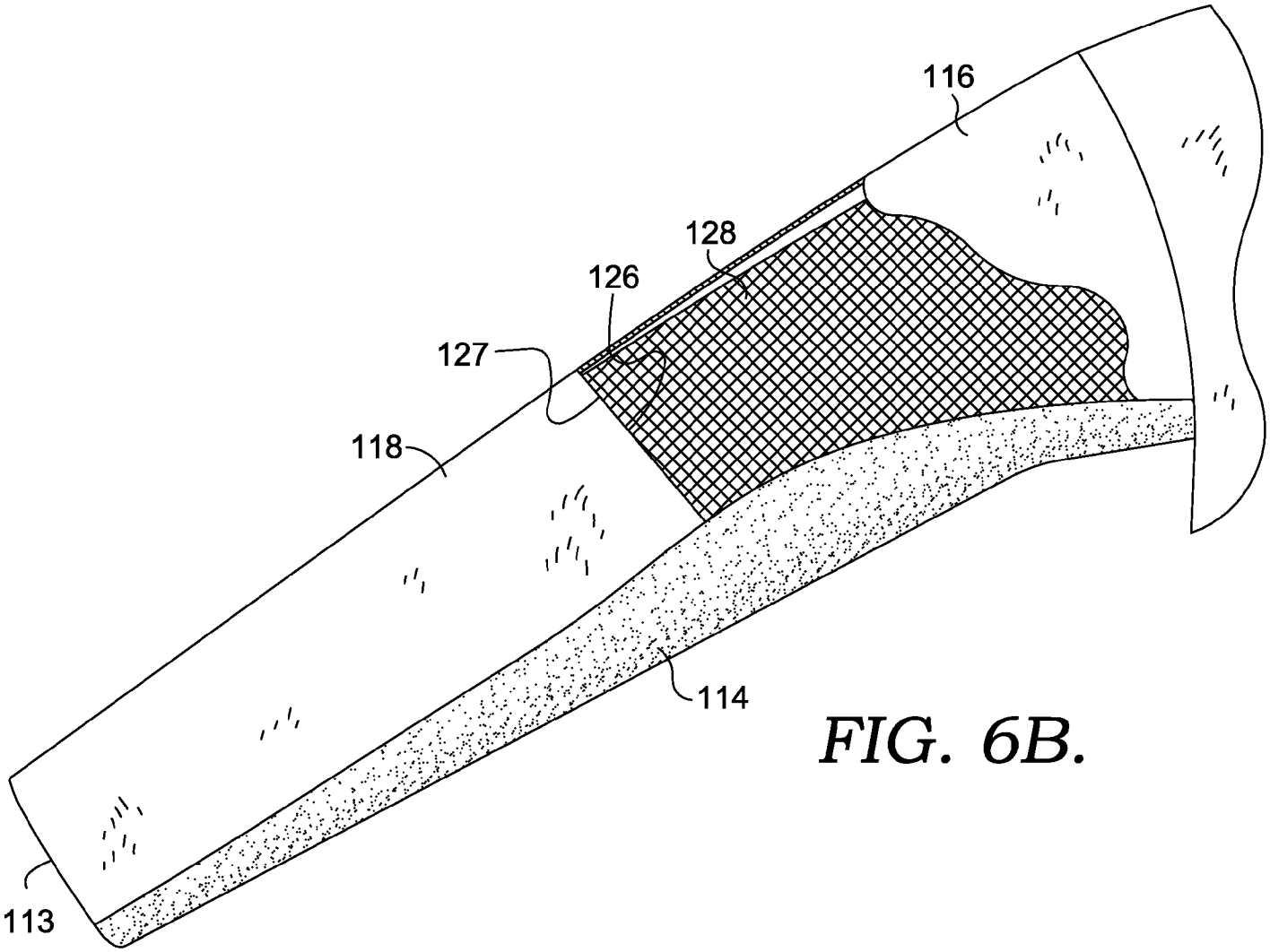
FIG. 6B depicts a cut-away back view of the exemplary left sleeve of FIG. 5, in accordance with aspects herein.

FIGS. 6A and 6B depict cutaway views of the second sleeve 112, as shown in FIGS. 4 and 5 respectively in accordance with aspects herein. As shown, the elastically resilient panel 128 is shown being positioned adjacent and interior to the second panel 116. In other words, an outer-facing surface of the elastically resilient panel 128 is positioned adjacent to an inner-facing surface of the second panel 116. The second sleeve 112 is shown in the at-rest or neutral configuration, such that the elastically resilient panel 128 extends past the first edge 120 (not shown due to the cut-away view of FIGS. 6A and 6B) of the second panel 116 where it is affixed to the first edge 126 of the third panel 118.

For the purposes of discussion herein, the first panel 114, the second panel 116, and the third panel 118 may comprise an outer sleeve assembly, while the elastically resilient panel 128 may comprise an inner sleeve assembly. The cutaway view of the second sleeve 112 shown in FIGS. 6A and 6B has been provided for enhanced understanding that the elastically resilient panel 128 comprises an inner sleeve assembly positioned adjacent at least in part to the outer sleeve assembly. In other words, the positioning of an inner sleeve assembly adjacent the outer sleeve assembly creates a layered construction of the second sleeve 112. As described herein, the second sleeve 112 is described as comprising multiple panels. However, it is contemplated that the entire sleeve may be constructed of a single piece of engineered fabric without seams between the different panels. Additionally, the engineered fabric, as contemplated herein, may eliminate the need for an outer sleeve assembly and an inner sleeve assembly. Instead, the outer sleeve assembly and the inner sleeve assembly may merely be formed as an inherent property of the engineered fabric.

Figure 7:
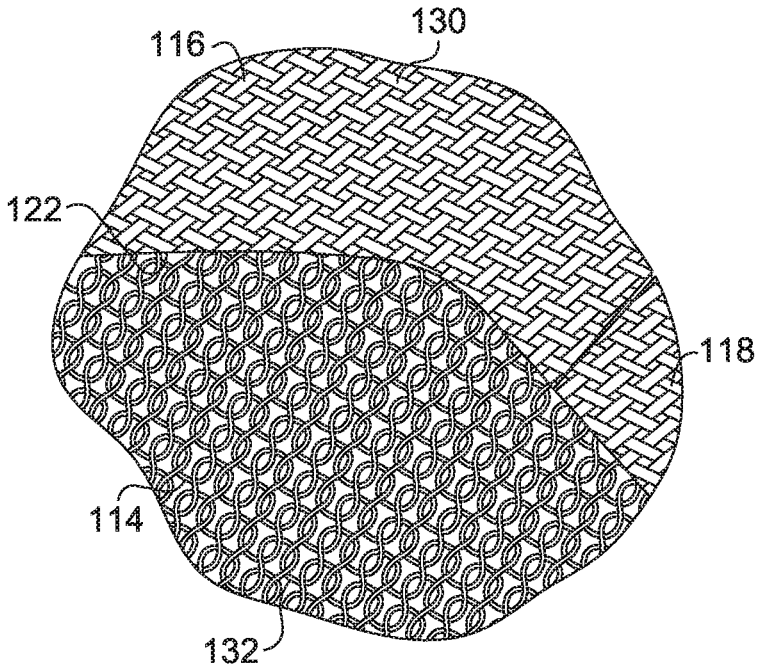
FIG. 7 depicts a detailed perspective view of the sleeve construction of FIG. 1 taken at the area indicated, in accordance with aspects herein.

Turning now to FIG. 7, a detailed perspective view of the article of apparel 100 taken at the area indicated on FIG. 1 is provided in accordance with aspects herein. As discussed previously, the first panel 114 may generally be formed from a knit fabric 132. And the second and third panels 116 and 118 may be formed from a woven fabric 130. As discussed previously, it is contemplated that the coarseness or fineness of the knit fabric 132 used to form first panel 114 may be adjusted to achieve the lowest coefficient of friction possible between the sleeves 110 and 112 and the torso portion of the article of apparel 100. Additionally, as seen in FIG. 7, the first seam 122 may be used to couple the first panel 114 comprising the knit fabric 132 to the second panel 116 and the third panel 118 comprising the woven fabric 130.

Figures 8A, 8B, 8C:
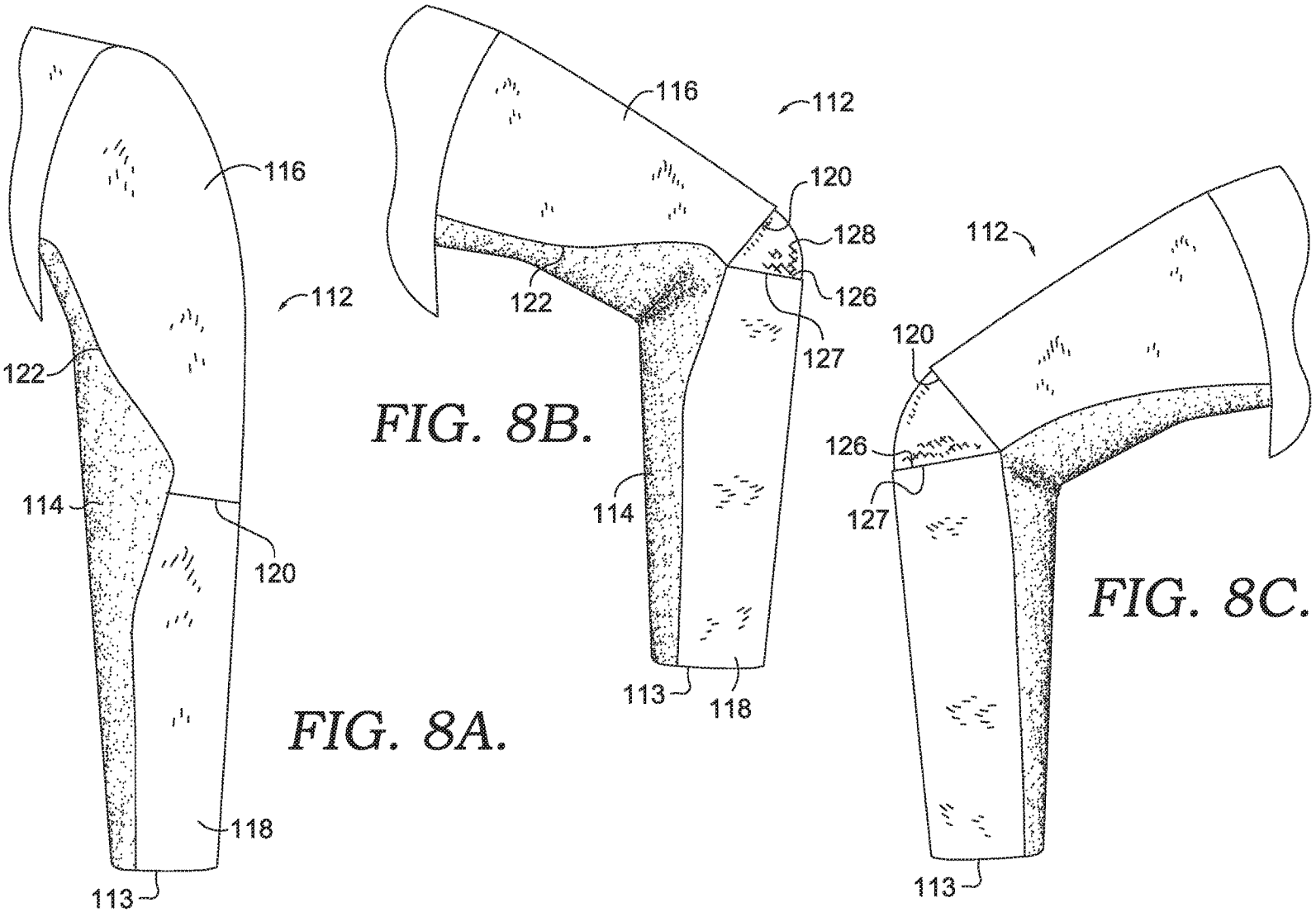
FIG. 8A depicts a front view of an exemplary left sleeve of an article of apparel in a neutral configuration, in accordance with aspects herein.
FIG. 8B depicts a front view of the exemplary left sleeve of FIG. 8A in a bent configuration, in accordance with aspects herein.
FIG. 8C depicts a back view of the exemplary left sleeve of FIG. 8A in a bent configuration, in accordance with aspects herein.

Turning now to FIGS. 8A, 8B and 8C, multiple views of the second sleeve 112 are depicted in accordance with aspects herein. The second sleeve 112 of FIG. 8A is shown as a front view in the "at-rest" or "neutral" configuration, as discussed previously. In the at-rest or neutral configuration, the first edge 120 of the second panel 116 overlaps the first edge 126 of the third panel 118 and the edge 127 of the elastically resilient panel 128.

On the other hand, in FIG. 8B, a front view of the second sleeve 112 in a "bent" configuration is illustrated. When the second sleeve 112 is in a bent configuration as seen in FIG. 8B, the elastically resilient panel 128 is exposed between the first edge 120 of the second panel 116 and the first edge 126 of the third panel 118. Additionally, in this bent configuration, the elastically resilient panel 128 is exposed between the second panel 116 and the third panel 118 to cover the elbow region of a wearer. The positioning of the elastically resilient panel 128 in this location provides the wearer of the article of apparel 100 additional freedom of motion when wearing the article of apparel 100. For example, by using the elastically resilient panel 128, the second and third panels 116 and 118 do not act to limit the bending movement of the wearer's arm. Additionally, having the elastically resilient panel 128 positioned intermediately between the second panel 116 and the third panel 118 causes the elastically resilient panel 128 to act as a cantilever between the first edge 120 of the second panel 116 and the first edge 126 of the third panel 118. In other words, the elastically resilient panel 128 carries a high amount of tension when in a bent configuration, such that the second sleeve 112 has a natural tendency to return to an "at-rest" or "neutral" configuration. Moreover, by forming the elastically resilient panel 128 of a mesh material, additional breathability and permeability characteristics are imparted to the second sleeve 112.

FIG. 8C, in a similar manner to FIGS. 8A and 8B, depicts a back view of the second sleeve 112 in a bent configuration. As discussed with respect to FIG. 8B, the elastically resilient panel 128 of the second sleeve 112 acts as a cantilever between the second panel 116 and the third panel 118. In other words, the elastically resilient panel 128 carries tension when the second sleeve 112 is in a bent configuration, such that the second sleeve 112 has a natural tendency to return to a neutral or at-rest configuration, as shown in FIG. 8A.

Figure 9:
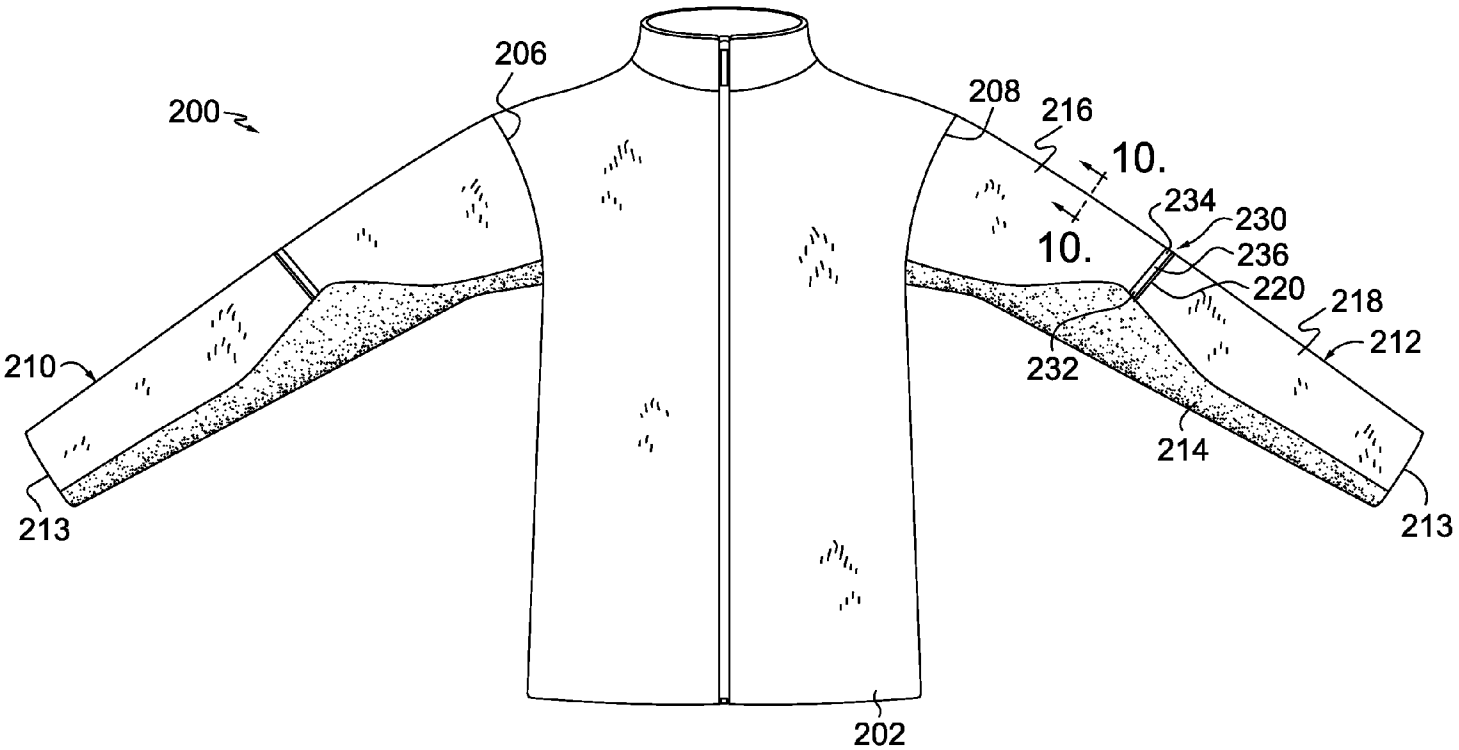
FIG. 9 depicts a front view of an article of apparel having an exemplary sleeve construction, in accordance with aspects herein.

Turning now to FIG. 9, a front view of an article of apparel 200 is depicted in accordance with aspects herein. Similar to the article of apparel 100, the article of apparel 200, comprises a front panel 202, a back panel (not shown), a first sleeve opening 206, a second sleeve opening 208, a first sleeve 210, and a second sleeve 212. And similar to the first and second sleeves 110 and 112, the first and second sleeves 210 and 212 may each comprise a distal end 213, a first panel 214, a second panel 216, and a third panel 218.

FIG. 9 is provided to illustrate how a reinforcement strip 230 (shown with respect to the second sleeve 212) may be used to reinforce, for instance, the first edge 220 of the first panel 214. The reinforcement strip 230 is generally positioned at the first edge 220 of the second panel 216. The reinforcement strip 230 may provide useful properties to the sleeve construction, including but not limited to elasticity, durability, resistance to abrasion, resistance to oil, water, and the like. The reinforcement strip 230 in exemplary aspects may comprise a thermoplastic polyurethane (TPU) having adhesive on one side of the reinforcement strip 230, so as to provide an attachment mechanism for use with the article of apparel 200. However, it is contemplated herein, that the reinforcement strip 230 may be formed of other materials, such as silicone, rubber, fabric, plastic, and the like. In accordance with an aspect herein, the reinforcement strip 230 may comprise a first end 232, an opposing second end 234, and an intervening portion 236.

Figure 10:
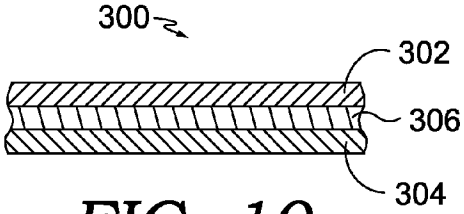
FIG. 10 depicts a cross-sectional view of the sleeve construction of FIG. 9 taken along cut line10-10 and illustrates a composite fabric, in accordance with aspects herein.

Turning now to FIG. 10, a composite fabric 300 is depicted taken at cut-line 10-10 of FIG. 9, in accordance with an aspect herein. The composite fabric 300 in exemplary aspects may be used to form the second panel 216 and the third panel 218. Further, the composite fabric 300 may be used to form the first panel 214. In general, the composite fabric 300 may comprise a face fabric 302, a back fabric 304, and an air-permeable membrane 306, which is generally positioned between the face fabric 302 and the back fabric 304. The face fabric 302, in exemplary aspects, may be treated with a durable water repellant (DWR) to impart water resistance to the sleeve construction. In one aspect, when used to form the second and third panels 216 and 218, the face fabric 302 and/or the back fabric 304 may be a woven textile. When used to form, for instance, the first panel 214, the face fabric 302 and/or the back fabric 304 may comprise a knit textile. In one exemplary aspect, the air-permeable membrane 306 may comprise a nanofiber material that is spun by a fine web process such as electrospinning. The air-permeable membrane 306 may achieve varying amounts of air-permeability through varying the density of the electrospun fibers in the air-permeable layer. The density of the electrospun fibers in the air-permeable membrane 306 may be varied by, for instance, slowing down the electrospinning process so that more fibers are deposited per square inch. More layers of electrospun fibers generally cause the air-permeable membrane 306 to exhibit greater waterproof characteristics. Conversely, the density of the electrospun fibers in the air-permeable membrane 306 may be decreased by speeding up the electrospinning process. Also conversely, a lower density of electrospun fibers causes the air-permeable membrane 306 to exhibit less waterproof characteristics.

Although aspects herein relate to a sleeve construction, it is contemplated herein that the use of an elastically resilient panel to span a movable joint space may be applied to other articles of apparel. For instance, the configuration described may be used in a knee region of a pant to impart increased mobility to this area. For instance, the second and third panels as well as the elastically resilient panel may be positioned on an anterior aspect of the pant such that the elastically resilient panel is adapted to be positioned adjacent to a knee region of a wearer when the article of apparel is worn. Thus, when the wearer bends her knee, the edges of the second and third panels are drawn apart, and the elastically resilient panel is used to provide increased mobility in this area while assisting the second and third panels to resume a neutral state when the bending action is finished.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An article of apparel for an upper torso of a wearer, the article of apparel comprising:

at least one front panel adapted to cover a front torso area of the wearer when the article of apparel is in an as-worn configuration;

at least one back panel adapted to cover a back torso area of the wearer when the article of apparel is in the as-worn configuration;

at least a first sleeve opening positioned at least partially between the at least one front panel and the at least one back panel; and at least a first sleeve coupled to the first sleeve opening and terminating at a distal end, the first sleeve comprising:

an outer sleeve assembly comprising: 1) a first panel extending from the first sleeve opening to the distal end; 2) a second panel extending from the first sleeve opening to a point approximately midway the length of the first sleeve where it terminates in a first edge; and 3) a third panel extending from the point approximately midway the length of the first sleeve to the distal end, wherein the third panel comprises at least a first edge that is discontinuously affixed to the first edge of the second panel to form an opening, wherein the second panel and the third panel are further affixed to the first panel at least at a first seam and a second seam; and an inner sleeve assembly positioned adjacent to a portion of the outer sleeve assembly, the inner sleeve assembly comprising an elastically resilient panel having at least a first edge affixed to the first sleeve opening and a second edge affixed to the first edge of the third panel, wherein the second edge of the inner sleeve assembly is unaffixed to the first edge of the second panel.

2. The article of apparel of claim 1, wherein the first panel comprises a knit fabric.

3. The article of apparel of claim 2, wherein the second panel and the third panel comprise a woven fabric.

4. The article of apparel of claim 1, wherein the first panel extends around approximately one-half of a circumference of the first sleeve adjacent the first sleeve opening and adjacent the distal end, and wherein the first panel extends around approximately three-quarters of the circumference of the first sleeve adjacent the first edge of the second panel.

5. The article of apparel of claim 1, wherein at least the first edge of the second panel comprises a reinforcement strip having a first end, a second end, and an intervening portion between the first end and the second end.

6. The article of apparel of claim 1, wherein the first panel extending from the first sleeve opening to the distal end further comprises at least a fourth panel.

7. The article of apparel of claim 1, wherein the first edge of the second panel overlaps the first edge of the third panel when the first sleeve is in a neutral configuration.

8. The article of apparel of claim 7, wherein when the first sleeve is in a bent configuration, the first edge of the second panel and the first edge of the third panel are pulled apart to expose the elastically resilient panel.

9. An article of apparel for an upper torso of a wearer, the article of apparel comprising:

at least a front panel adapted to cover a front torso area of the wearer when the article of apparel is in an as-worn configuration;

at least a back panel adapted to cover a back torso area of the wearer when the article of apparel is in the as-worn configuration;

a first sleeve opening positioned at least partially between the front panel and the back panel;

at least a first sleeve coupled to the first sleeve opening, the first sleeve comprising:

a medial panel extending from the first sleeve opening towards a distal end of the first sleeve;

a lateral proximal panel extending from the first sleeve opening to a first edge, wherein the first edge is positioned approximately midway between a proximal end of the first sleeve and the distal end of the first sleeve;

a lateral distal panel, wherein a first edge of the lateral distal panel is discontinuously affixed to a portion of the first edge of the lateral proximal panel thereby forming an opening, and wherein a second edge of the lateral distal panel forms at least a portion of the distal end of the first sleeve; and an inner panel comprising an elastically resilient material, the inner panel positioned adjacent to the lateral proximal panel and extending from the first sleeve opening to the first edge of the lateral distal panel, wherein a distal edge of the inner panel is unaffixed to the first edge of the lateral proximal panel.

10. The article of apparel of claim 9, wherein the medial panel comprises a knit fabric.

11. The article of apparel of claim 10, wherein the lateral proximal panel and the lateral distal panel comprise a woven fabric.

12. The article of apparel of claim 9, wherein the distal edge of the inner panel is affixed to the first edge of the lateral distal panel.

13. A sleeve for an article of apparel, the sleeve comprising:

a proximal end and a distal end;

a medial panel extending from the proximal end of the sleeve towards the distal end of the sleeve, the medial panel comprising a knit fabric;

a lateral proximal panel extending from the proximal end of the sleeve to a first edge, wherein the first edge is positioned at a location approximately midway between the proximal end and the distal end of the sleeve, the lateral proximal panel comprising a woven fabric;

a lateral distal panel, wherein a first edge of the lateral distal panel is discontinuously affixed to the first edge of the lateral proximal panel, and wherein a second edge of the lateral distal panel forms at least a portion of the distal end of the sleeve, the lateral distal panel comprising a woven fabric; and an inner panel positioned adjacent to an inner-facing surface of the lateral proximal panel and extending from the proximal end of the sleeve to the location approximately midway between the proximal end and the distal end of the sleeve, wherein a distal edge of the inner panel is affixed to the first edge of the lateral distal panel, and wherein the distal edge of the inner panel is unaffixed to the first edge of the lateral proximal panel.

14. The sleeve of claim 13, wherein the medial panel comprises a first elasticity and the lateral proximal panel and the lateral distal panel comprise a second elasticity.

15. The sleeve of claim 14, wherein the first elasticity is greater than the second elasticity.

16. The sleeve of claim 15, wherein the inner panel comprises an elastically resilient mesh having a third elasticity.

17. The sleeve of claim 16, wherein the third elasticity is greater than the first elasticity and the second elasticity.

18. The sleeve of claim 13, wherein the medial panel, the lateral proximal panel and the lateral distal panel are formed from a composite fabric.

19. The sleeve of claim 18, wherein the composite fabric comprises a face fabric, a back fabric, and an air-permeable membrane located between the face fabric and the back fabric.

20. A construction for an article of apparel, the construction comprising:

a proximal end and a distal end, wherein the proximal end is configured to be affixed to the article of apparel;

a first panel extending from the proximal end of the construction to a first edge;

a second panel having a proximal edge that is discontinuously affixed to the first edge of the first panel to form an opening; and a third panel comprising an elastically resilient material positioned adjacent to an inner-facing surface of the first panel and extending from the proximal end of the construction to a distal edge, wherein the distal edge of the third panel is affixed to the proximal edge of the second panel, and wherein the distal edge of the third panel is unaffixed to the first edge of the first panel.

21. The construction of claim 20, wherein the construction comprises a sleeve.

22. The construction of claim 20, wherein the construction comprises a leg portion of a pant.

23. The construction of claim 22, wherein the first panel, the second, panel, and the third panel are positioned on an anterior face of the leg portion.

24. The construction of claim 23, wherein the opening is configured to be positioned adjacent to a knee area of a wearer when the article of apparel is worn.

25. The construction of claim 24, further comprising a fourth panel extending from the proximal end of the construction to the distal end of the construction.

26. The construction of claim 25, wherein the fourth panel is positioned on a posterior face of the leg portion.

27. The construction of claim 26, wherein the fourth panel is affixed to at least the first panel and the second panel.

* * * * *